US009070993B2

(12) United States Patent
Honda

(10) Patent No.: US 9,070,993 B2
(45) Date of Patent: Jun. 30, 2015

(54) CONNECTOR

(71) Applicant: Japan Aviation Electronics Industry, Limited, Tokyo (JP)

(72) Inventor: Yosuke Honda, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 135 days.

(21) Appl. No.: 13/873,976

(22) Filed: Apr. 30, 2013

(65) Prior Publication Data

US 2013/0309887 A1 Nov. 21, 2013

(30) Foreign Application Priority Data

May 18, 2012 (JP) ..... 2012-114678

(51) Int. Cl.
*H01R 12/88* (2011.01)
*H01R 13/193* (2006.01)

(52) U.S. Cl.
CPC ..... *H01R 13/193* (2013.01); *H01R 12/88* (2013.01)

(58) Field of Classification Search
CPC ..... H01R 12/88; H01R 12/79
USPC ..... 439/260, 495
See application file for complete search history.

(56) References Cited

U.S. PATENT DOCUMENTS 6,254,406 B1 * 7/2001 Chiu et al. ..... 439/142
6,338,648 B1 * 1/2002 Miura et al. ..... 439/495
6,679,713 B2 * 1/2004 Miura ..... 439/260
6,790,074 B1 * 9/2004 Chiu ..... 439/495
6,921,274 B2 * 7/2005 Yu ..... 439/260
6,971,908 B2 * 12/2005 Shiu et al. ..... 439/495
7,029,319 B2 * 4/2006 Kunishi ..... 439/492
7,083,455 B1 * 8/2006 Miura et al. ..... 439/260
7,261,589 B2 * 8/2007 Gillespie et al. ..... 439/495
7,267,574 B2 * 9/2007 Wei et al. ..... 439/495
7,270,567 B2 * 9/2007 Inoue ..... 439/495
7,275,948 B2 * 10/2007 Miura et al. ..... 439/260
7,387,528 B2 * 6/2008 Lee et al. ..... 439/495
7,399,193 B1 * 7/2008 Ho et al. ..... 439/260
7,435,122 B2 * 10/2008 Suzuki et al. ..... 439/260
7,435,130 B2 * 10/2008 Shen et al. ..... 439/495
7,455,547 B2 * 11/2008 Hemmi et al. ..... 439/495
7,534,131 B2 * 5/2009 Chung ..... 439/495
7,553,183 B2 * 6/2009 Taketomi et al. ..... 439/495
7,578,688 B2 * 8/2009 Wu ..... 439/260

(Continued)

FOREIGN PATENT DOCUMENTS

JP 10-214659 8/1998
JP 2005-129418 5/2005

(Continued)

*Primary Examiner* — Ross Gushi
(74) *Attorney, Agent, or Firm* — Hovey Williams LLP

(57) ABSTRACT

A connector includes a housing having an insertion portion an upper part of which is opened so as to insert a connection end portion of a connection target having a plurality of contact portions, and at least one confirmation groove for viewing a tip end position of the connection end portion of the connection target inserted into the insertion portion from above, an actuator rotatably attached to the housing between an open position where the upper part of the insertion portion is opened and a closed position where the upper part of the insertion portion is covered, and a portion of the actuator which is located right above the confirmation groove of the housing when the actuator is located at the open position is cut out, and a plurality of contacts fixed to the housing.

4 Claims, 9 Drawing Sheets

(56) References Cited

U.S. PATENT DOCUMENTS

| | | | | |
|---|---|---|---|---|
| 7,581,974 | B2 * | 9/2009 | Liu et al. | 439/260 |
| 7,628,642 | B2 * | 12/2009 | Chen et al. | 439/495 |
| 7,661,972 | B2 * | 2/2010 | Okamura et al. | 439/260 |
| 7,722,373 | B2 * | 5/2010 | Nemoto | 439/260 |
| 7,736,164 | B2 * | 6/2010 | Okamura | 439/260 |
| 7,789,698 | B2 * | 9/2010 | Hashimoto et al. | 439/495 |
| 7,833,035 | B2 * | 11/2010 | Lin et al. | 439/260 |
| 7,837,489 | B2 * | 11/2010 | Kameda | 439/260 |
| 7,887,351 | B2 * | 2/2011 | Wang et al. | 439/260 |
| 7,892,002 | B2 * | 2/2011 | Shen et al. | 439/260 |
| 7,909,630 | B2 * | 3/2011 | Yamada | 439/260 |
| 8,043,104 | B2 * | 10/2011 | Taketomi | 439/260 |
| 8,128,425 | B2 * | 3/2012 | Takahashi et al. | 439/260 |
| 8,133,067 | B2 * | 3/2012 | Tsai et al. | 439/260 |
| 8,177,571 | B2 * | 5/2012 | Yokoo et al. | 439/260 |
| 8,616,906 | B2 * | 12/2013 | Iijima et al. | 439/260 |
| 8,636,531 | B2 * | 1/2014 | Sasaki et al. | 439/260 |
| 8,672,698 | B2 * | 3/2014 | Sasaki et al. | 439/260 |
| 8,851,914 | B2 * | 10/2014 | Lin et al. | 439/260 |
| 2002/0106924 | A1 * | 8/2002 | Uehara | 439/260 |
| 2002/0115326 | A1 * | 8/2002 | Yamane | 439/260 |
| 2002/0115327 | A1 * | 8/2002 | Yamane | 439/260 |
| 2002/0115340 | A1 * | 8/2002 | Yamane | 439/495 |
| 2002/0137383 | A1 * | 9/2002 | Tsunematsu | 439/260 |
| 2002/0137384 | A1 * | 9/2002 | Tsunematsu | 439/260 |
| 2004/0171293 | A1 * | 9/2004 | Tsunematsu | 439/260 |
| 2004/0180572 | A1 * | 9/2004 | Chiu | 439/495 |
| 2004/0248447 | A1 * | 12/2004 | Aoki | 439/260 |
| 2004/0266242 | A1 * | 12/2004 | Shiu et al. | 439/260 |
| 2005/0026487 | A1 * | 2/2005 | Yu | 439/260 |
| 2005/0118849 | A1 * | 6/2005 | Okita et al. | 439/260 |
| 2005/0208824 | A1 * | 9/2005 | Kayama et al. | 439/495 |
| 2006/0089045 | A1 * | 4/2006 | Miura et al. | 439/495 |
| 2006/0121776 | A1 * | 6/2006 | Kao | 439/495 |
| 2006/0141837 | A1 * | 6/2006 | Okano | 439/260 |
| 2006/0160390 | A1 * | 7/2006 | Miura et al. | 439/260 |
| 2006/0199410 | A1 * | 9/2006 | Chen | 439/260 |
| 2006/0216981 | A1 * | 9/2006 | Huang | 439/260 |
| 2006/0252302 | A1 * | 11/2006 | Wei et al. | 439/495 |
| 2006/0292910 | A1 * | 12/2006 | Lee et al. | 439/260 |
| 2006/0292911 | A1 * | 12/2006 | Ning | 439/260 |
| 2007/0054529 | A1 * | 3/2007 | Harlan et al. | 439/260 |
| 2007/0066127 | A1 * | 3/2007 | Inoue | 439/495 |
| 2007/0105423 | A1 * | 5/2007 | Gillespie et al. | 439/260 |
| 2007/0155213 | A1 * | 7/2007 | Shin | 439/260 |
| 2008/0171460 | A1 * | 7/2008 | Liu et al. | 439/260 |
| 2008/0254662 | A1 * | 10/2008 | Koga | 439/260 |
| 2010/0130044 | A1 * | 5/2010 | Taketomi | 439/260 |
| 2011/0223790 | A1 | 9/2011 | Hoshino et al. | |
| 2013/0023138 | A1 * | 1/2013 | Sasaki et al. | 439/260 |
| 2013/0309887 | A1 * | 11/2013 | Honda, Yosuke | 439/260 |

FOREIGN PATENT DOCUMENTS

| | | |
|---|---|---|
| JP | 2009-070577 | 4/2009 |
| JP | 2011-192470 | 9/2011 |

* cited by examiner

FIG. 1A
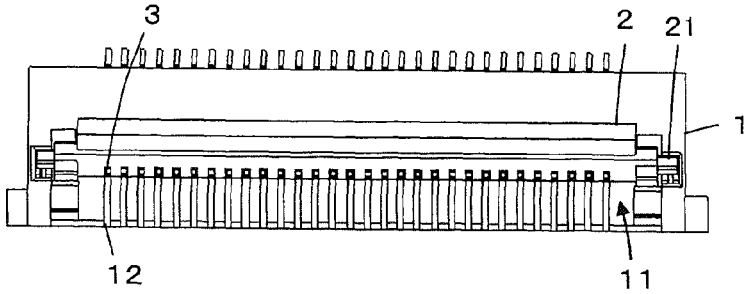
FIG. 1B
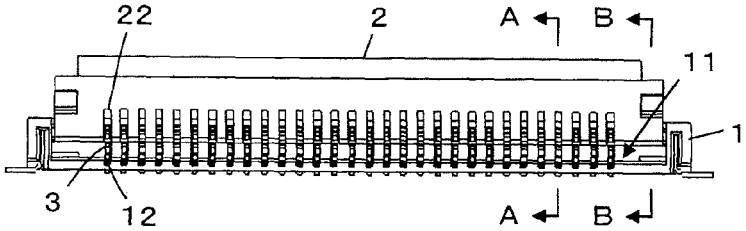
FIG. 1C
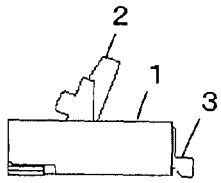
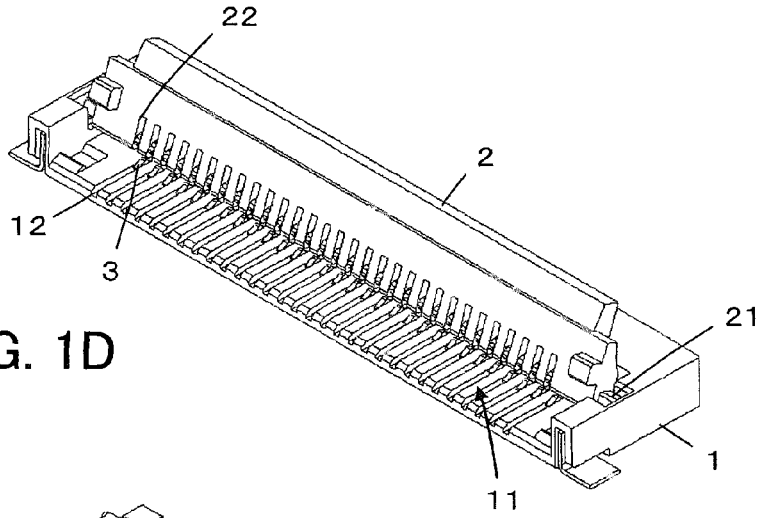
FIG. 1D
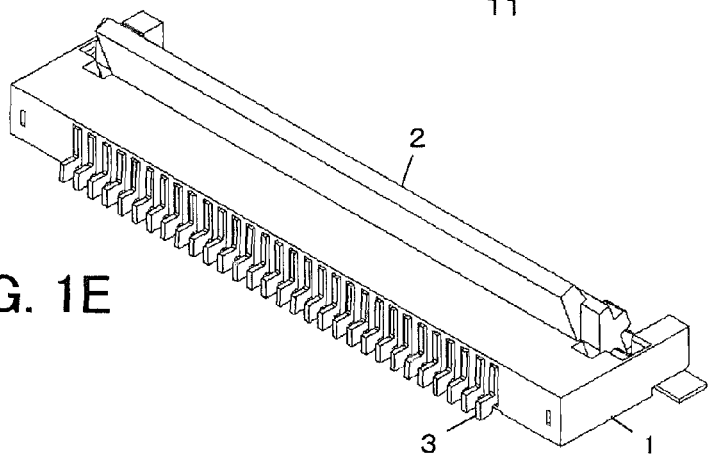
FIG. 1E

CONNECTOR

RELATED APPLICATIONS

This application claims priority to Japanese Patent Application No. 2012-114678, filed on May 18, 2012. The foregoing is incorporated by reference herein.

BACKGROUND OF THE INVENTION

The present invention relates to a connector, and in particular, relates to a connector which performs a connection with a sheet shaped or a flat-plate shaped connection target such as an FPC (Flexible Printed Circuit), an FFC (Flexible Flat Cable), or the like.

In recent years, as the miniaturization and densification of electronic apparatuses, downsizing in the outer dimension of such a kind of connector is required, as well, and a thin component is being used as a component of a housing or the like which configures the connector. For this reason, it takes time when inserting a connection target into a connector, and a confirming operation for confirming whether or not the connection target is completely inserted into the connector is necessary.

As a connector which is suitable for such a confirming operation, for example, JP 10-214659 A discloses a connector in which an inspection hole 62 for confirming is formed in a housing 61, as illustrated in FIG. 15. When a connection target 63 such as an FPC, or the like is inserted up to a predetermined position in the housing 61 from an insertion opening 64 formed in the housing 61, a contact portion 65 which is formed on the surface of the connection target 63 is normally connected to a contact 66 which is fixed into the housing 61, and at this time, it is possible to confirm that the connection target 63 is inserted up to the predetermined position from above the housing 61 through the inspection hole 62.

However, in this connector, the connection target 63 should be inserted from the insertion opening 64 which is formed on the side portion of the housing 61, and in case the outer dimension of the connector is small, an insertion operation of the connection target 63 becomes difficult. In addition, since there is no mechanism which locks a position of the connection target 63 with respect to the connector, even if the insertion up to the predetermined position of the connection target 63 is once confirmed, there is a concern that the position of the connection target 63 may be deviated due to stress which is applied to the connection target 63 thereafter.

In contrast to this, as illustrated in FIG. 16, a connector has been developed in which an actuator 68 is attached to a housing 67 so as to be rotatable, a front end portion of a connection target 69 such as the FPC, FFC, or the like is inserted up to a slightly forward position of the actuator 68 in a state in which the actuator 68 is opened at an angle of 90° or more to the housing 67, and then mechanically holds the connection target 69 by closing the actuator 68.

In the connector having such an actuator 68, it is possible to easily perform the insertion operation of the connection target 69 even when the connector is small, since the connection target 69 is inserted in a state in which the actuator 68 is open, and moreover, it is possible to lock the position of the connection target 69 by mechanically holding the connection target 69 using the actuator 68. However, even when an inspection hole is formed in the vicinity of the actuator 68 of the housing 67 in order to confirm whether or not the connection target 69 is completely inserted, like the connector which is illustrated in FIG. 15, in a state in which the actuator 68 is open, the actuator 68 is located right above the inspection hole by being inclined by 90° or more to the housing 67, and thus it is not possible to confirm the insertion of the connection target 69 from the upper part of the housing 67 through the inspection hole.

Even granting that an inspection hole is formed in the actuator 68, as well, and the confirmation of insertion of the connection target 69 is performed from above through both the inspection hole of the housing 67 and the inspection hole of the actuator 68, when the actuator 68 is opened at an angle of 90° or more, the inspection hole should be obliquely formed with respect to the actuator 68, and it is difficult to mold the actuator 68 from the viewpoint of structure of metal mold. In addition, when there is an inspection hole, it is difficult to achieve miniaturization since resin for molding becomes difficult to flow in the metal mold, a warp is apt to occur in the molded actuator 68, and the strength of the molded actuator 68 also decreases.

Therefore, as illustrated in FIG. 17, in a connector which is disclosed in JP 2009-70577 A, an insertion member 71 in which an inspection hole is formed in the vertical direction is prepared as a different component from a housing 70, a connection target 72 is inserted into the housing 70, and then the insertion member 71 is inserted into the housing 70, thereby confirming an insertion of the connection target 72 while locking the connection target 72.

However, in a structure in which the insertion member 71 as a different component is inserted into the housing 70, it is not possible to satisfy a demand for miniaturizing. In addition, since similarly to the connector illustrated in FIG. 15, the upper part of the insertion portion of the connection target 72 is covered with the housing 70, an insertion operation of the connection target 72 becomes difficult, and thus the housing is not suitable for a small connector.

SUMMARY OF THE INVENTION

The present invention has been made in order to solve such a problem in the related art, and an object of the present invention is to provide a connector which is small, and in which it is possible to easily insert a sheet shaped or a flat plate-shaped connection target, and it is also possible to confirm the insertion of the connection target and to perform locking thereof.

A connector according to the present invention comprises:

a housing having an insertion portion an upper part of which is opened so as to insert a connection end portion of a connection target having a plurality of contact portions, and at least one confirmation groove for viewing a tip end position of the connection end portion of the connection target inserted into the insertion portion from above;

an actuator rotatably attached to the housing between an open position where the upper part of the insertion portion is opened and a closed position where the upper part of the insertion portion is covered, and a portion of the actuator which is located right above the confirmation groove of the housing when the actuator is located at the open position is cut out; and a plurality of contacts fixed to the housing, wherein the connection target is mechanically held in the housing with the plurality of contact portions of the connection target being electrically connected to the plurality of contacts by rotating operation of the actuator in relation to the housing.

BRIEF DESCRIPTION OF THE DRAWINGS

FIGS. 1A to 1E are diagrams illustrating a connector according to the first embodiment of the present invention, in which FIG. 1A is a plan view, FIG. 1B is a front view, FIG. 1C is a side view, FIG. 1D is a perspective view when viewed diagonally in front of the connector, and FIG. 1E is a perspective view when viewed diagonally behind of the connector.

FIGS. 4A to 4C are diagrams illustrating a housing used in the connector according to the first embodiment, in which FIG. 4A is a plan view, FIG. 4B is a front view, and FIG. 4C is a perspective view.

FIGS. 5A to 5D are diagrams illustrating an actuator used in the connector according to the first embodiment, in which FIG. 5A is a plan view, FIG. 5B is a front view, FIG. 5C is a side view, and FIG. 5D is a perspective view.

FIGS. 6A to 6C are diagrams illustrating the state of before locking the connector according to the first embodiment into which a connection target is inserted, in which FIG. 6A is a plan view, FIG. 6B is a front view, and FIG. 6C is a perspective view.

FIGS. 10A to 10C are diagrams illustrating the state of after locking the connector according to the first embodiment into which the connection target is inserted, in which FIG. 10A is a plan view, FIG. 10B is a front view, and FIG. 10C is a perspective view.

DETAILED DESCRIPTION OF THE INVENTION

Figure 2:
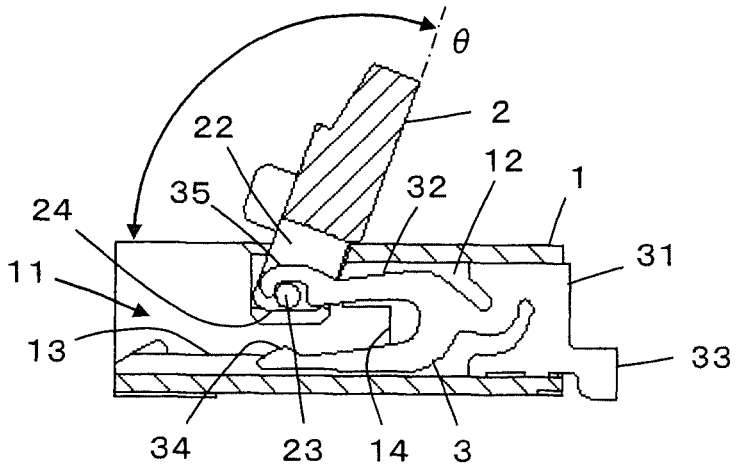
FIG. 2 is a cross-sectional view which is taken along the line A-A in FIG. 1B.

First Embodiment:

Hereinafter, the first embodiment of the present invention will be described based on accompanying drawings.

FIG. 1 illustrates a configuration of a connector according to the first embodiment. The connector is a small connector which performs a connection with a sheet shaped or a flat plate-shaped connection target such as an FPC (Flexible Printed Circuit), an FFC (Flexible Flat Cable), or the like, and includes a housing 1 the height of which is approximately 1 to 2 mm, an actuator 2 rotatably attached to the housing 1, and a plurality of contacts 3 fixed to the housing 1.

The housing 1 has an insertion portion 11 the upper part of which is opened in order to insert a connection end portion of a connection target, and the actuator 2 is attached to the housing 1 through shaft portions 21 which are formed in a protruding manner at both end portions, respectively, so as to rotate between an open position where the upper part of the insertion portion 11 of the housing 1 is opened and a closed position where the upper part of the insertion portion 11 is covered. FIGS. 1A to 1E illustrate the state in which the actuator 2 is located at the open position, that is, the upper part of the insertion portion 11 of the housing 1 is opened. When the upper part of the insertion portion 11 of the housing 1 is covered with the actuator 2 by rotating the actuator 2 to the closed position, the housing 1 and the actuator 2 jointly have an appearance of approximate rectangular shape.

The housing 1 is formed with a plurality of slits 12 which are parallel to one another and respectively penetrate from the front side to the rear side of the housing 1, and a plurality of contacts 3 which respectively correspond to the plurality of slits 12 are fixed to the slits 12 by press fitting. The actuator 2 is formed with a plurality of slits 22 which correspond to the plurality of slits 12 of the housing 1 vertically to a rotation shaft of the actuator 2 and in the vicinity of the rotation shaft.

As illustrated in FIG. 2, the respective contacts 3 are formed by a flat-plated member, and include a housing fixing portion 31 which is press-fitted into the corresponding slit 12 of the housing 1, a tuning fork-shaped portion 32 which is connected to the near side, that is, the front side of the housing fixing portion 31, and a substrate attaching portion 33 which is connected to the rear side of the housing fixing portion 31. One end of the tuning fork-shaped portion 32 is extended up to right below the rotation shaft of the actuator 2 along a base 13 of the insertion portion 11 of the housing 1 from the housing fixing portion 31 and forms a contact portion 34 which is located at the upper part of the base 13 of the insertion portion 11 of the housing 1, and the other end of the tuning fork-shaped portion 32 is extended so as to face the contact portion 34 and forms an engaging portion 35 which is engaged with a bar-shaped portion 23 formed in the slit 22 of the actuator 2. The substrate attaching portion 33 is protruded to the rear portion of the housing 1.

An end portion 14 which stands at a right angle to the base 13 of the insertion portion 11 is formed at a back portion of the insertion portion 11 of the housing 1. The end portion 14 is a portion which defines an insertion portion of the connection target when the connection end portion of the connection target is inserted into the insertion portion 11 of the housing 1 and the tip end of the connection end portion of the connection target impinges thereupon.

Further, a pressing portion 24 of a cam structure is formed at an end portion which is located between the slits 22 of the actuator 2 which are adjacent to each other and is close to the rotation shaft of the actuator 2. When the actuator 2 is located at the open position as illustrated in FIG. 2, the pressing portion 24 defines a gap enough for allowing the movement of the connection end portion of the connection target between the pressing portion 24 and the base 13 of the insertion portion 11 of the housing 1, and when the actuator 2 is located at the closed position, the pressing portion 24 defines a gap for inserting and pressing the connection end portion of the connection target between the pressing portion 24 and the base 13 of the insertion portion 11 of the housing 1.

When the actuator 2 is located at the open position, the actuator 2 becomes a state in which it is inclined to the housing 1 at a right angle or more, for example, the angle $\theta=115°$ to $120°$ as shown in FIG. 2, and the connector is configured such that the open position can be maintained stably.

Figure 3:
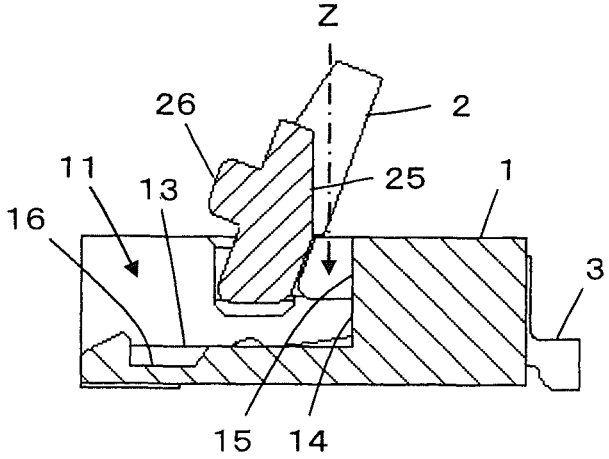
FIG. 3 is a cross-sectional view which is taken along the line B-B in FIG. 1B.

As illustrated in FIG. 3, the slits 12 are not formed in the housing 1 in the vicinity of both end portions of the actuator 2, and instead of the slits, confirmation grooves 15 are formed in the housing 1 such that the base 13 of the insertion portion 11 can be viewed from the upper part of the housing 1. The respective confirmation grooves 15 are extended in the vertical direction to the base 13 of the insertion portion 11 so as to be flush with the end portion 14 at both ends of the back portion of the insertion portion 11.

Further, as illustrated in FIG. 3, in the actuator 2, a portion which is located right above the confirmation groove 15 of the housing 1 when the actuator is located at the open position is cut out, and the actuator has a surface 25 which is approximately vertical to the base 13 of the insertion portion 11 when the actuator is located at the open position. In this manner, since there are no members which are present right above the confirmation groove 15 in a state in which the actuator 2 is located at the open position, it is possible to view the base 13 in the back portion of the insertion portion 11 through the confirmation groove 15 from the position Z which is right above the confirmation groove 15.

At both side end portions of the actuator 2, convex portions 26 are formed on a surface of the actuator 2 which is the opposite side to the surface 25, that is, a surface which faces the insertion portion 11 of the housing 1 when the actuator 2 is located at the closed position, and concave portions 16 respectively corresponding to the convex portions 26 of the actuator 2 are formed at the base 13 of the insertion portion 11 of the housing 1.

Figure 4A:
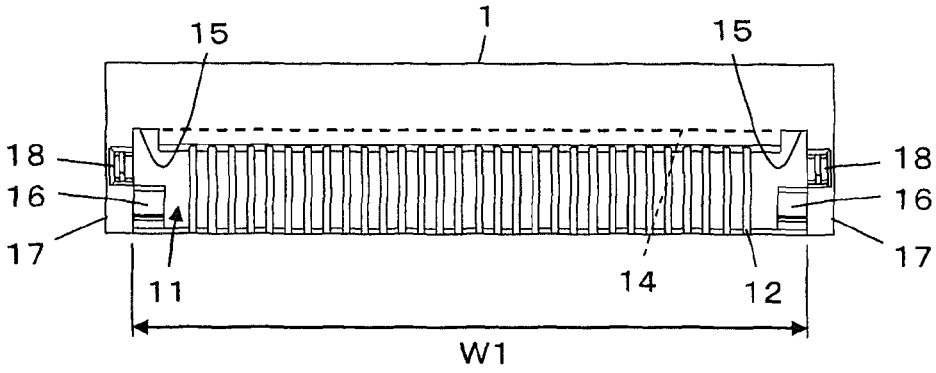
Figure 4B:
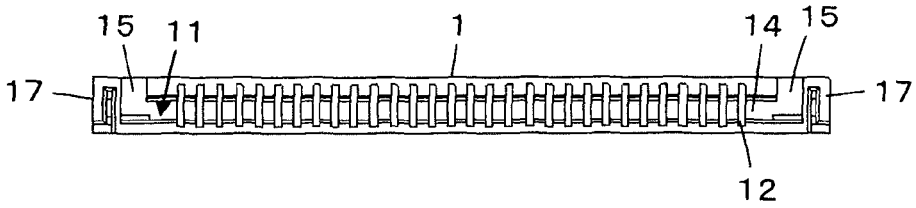
Figure 4C:
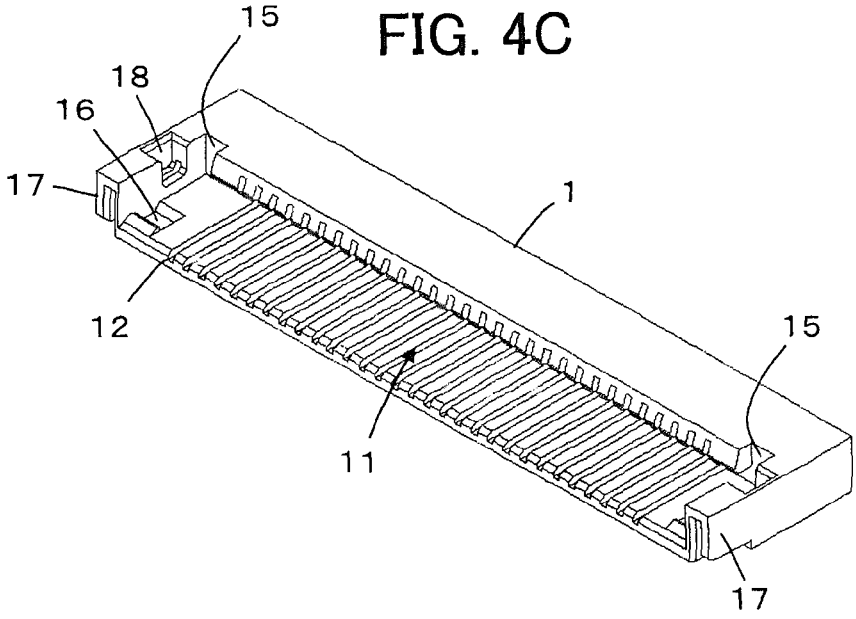
Figure 5A:
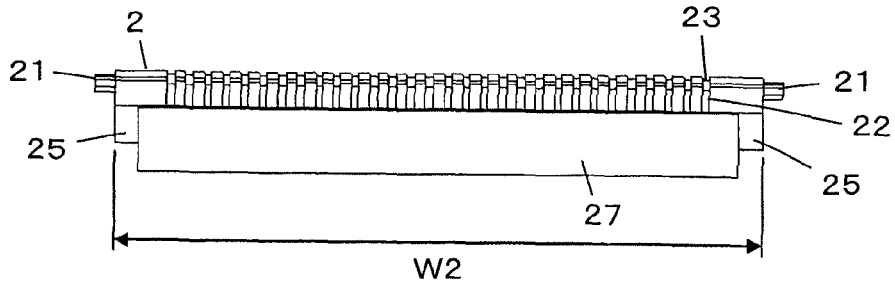
Figure 5B:
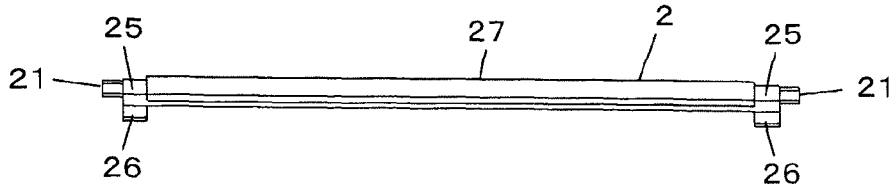
Figure 5C:
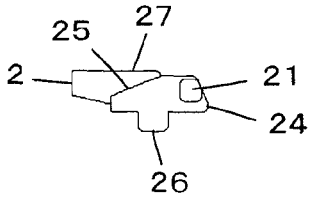
Figure 5D:
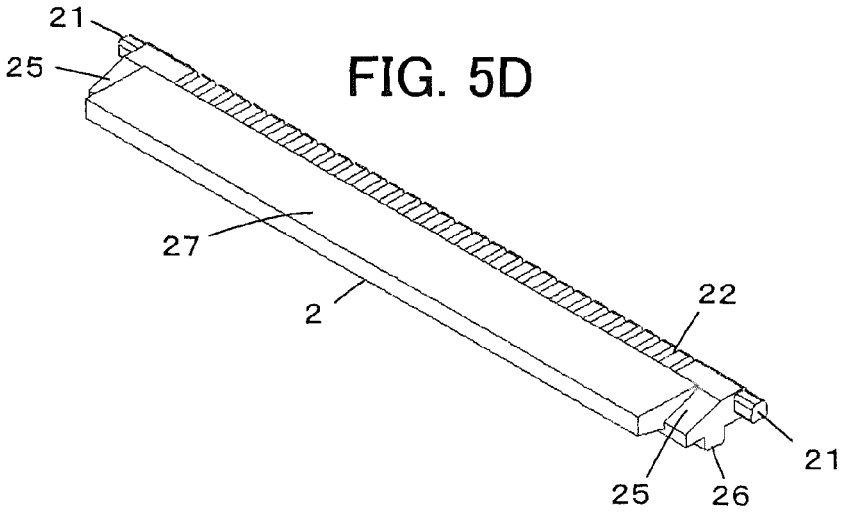

As illustrated in FIGS. 4A to 4C, side wall portions 17 are respectively provided at both side ends of the housing 1, and the insertion portion 11 having a width W1 which is slightly larger than the width of the connection target is formed between these side wall portions 17. In the back portion of the insertion portion 11, the end portions 14 which are formed between the respective slits of the plurality of slits 12 are extended throughout the overall width of the insertion portion 11 while forming the same plane, and are connected to the respective confirmation grooves 15 at both side ends of the insertion portion 11.

Bearing portions 18 which receive corresponding shaft portions 21 of the actuator 2 are formed in the side wall portions 17.

As illustrated in FIGS. 5A to 5D, the actuator 2 has the width W2 which is slightly smaller than the width W1 of the insertion portion 11 of the housing 1, and by inserting both the shaft portions 21 into the corresponding bearing portions 18 of the housing 1, respectively, the actuator 2 is rotatably attached to the housing 1 such that the upper part of the insertion portion 11 of the housing 1 can be opened and covered.

The surfaces 25 which are approximately vertical to the base 13 of the insertion portion 11 of the housing 1 when the actuator 2 is located at the open position are formed at both side ends of the actuator 2, respectively, and the surfaces 25 are inclined to a top face 27 of a center portion of the actuator 2 at a predetermined angle.

Subsequently, operations of the first embodiment will be described.

Figure 6A:
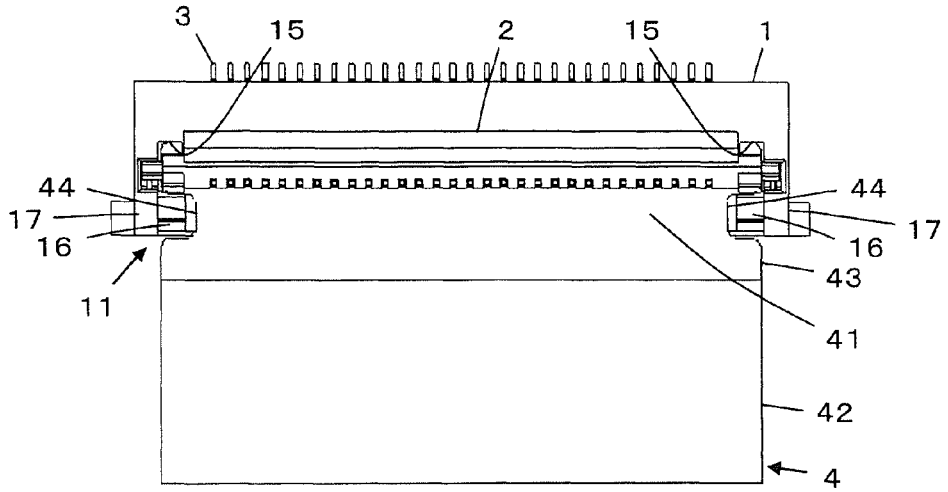
Figure 6B:
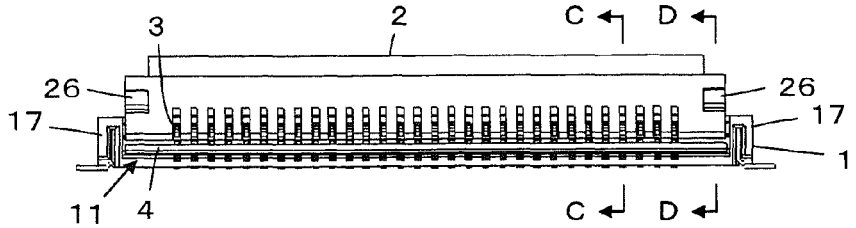
Figure 6C:
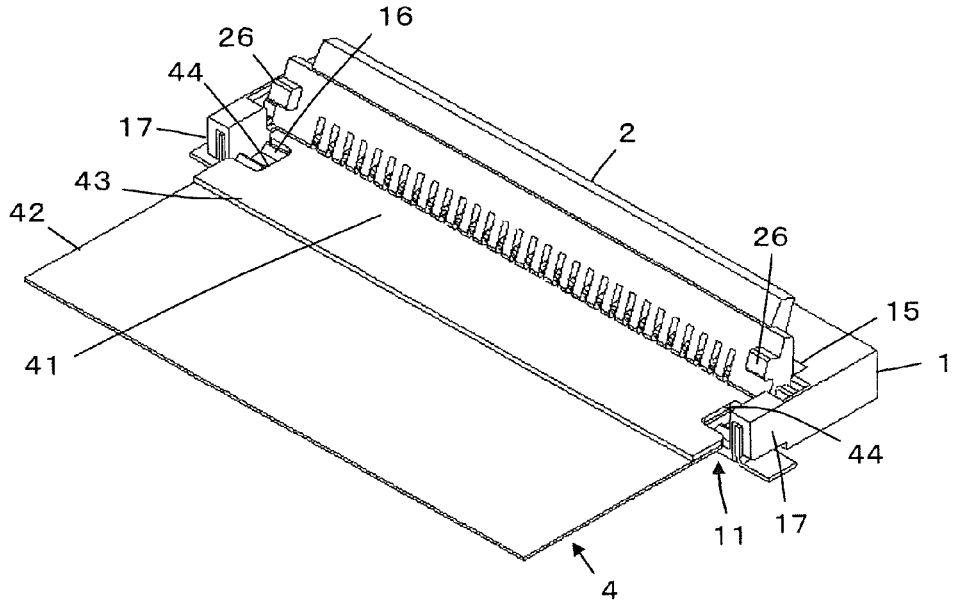

First, as illustrated in FIGS. 6A to 6C, a connection end portion 41 of a connection target 4 which is, for example, an FPC is inserted into the insertion portion 11 of the housing 1 in the state in which the actuator 2 is located at the open position. The connection target 4 includes an insulated substrate 42 which is thin and highly flexible, and a reinforcing plate 43 which is pasted onto one end portion of the insulated substrate 42. The reinforcing plate 43 is also flexible to some extent, and the connection end portion 41 of the connection target 4 is formed by pasting the insulated substrate 42 and the reinforcing plate 43 with each other. Portions of both side ends of the connection target 4 which are located above the concave portions 16 of the housing 1 when the connection end portion 41 of the connection target 4 is sufficiently inserted up to the back portion of the insertion portion 11 of the housing 1 are respectively cut out to form cutout portions 44.

When the actuator 2 is located at the open position, since a gap only for allowing the movement of the connection end portion 41 of the connection target 4 is defined between the pressing portion 24 of the cam structure of the actuator 2 and the base 13 of the insertion portion 11 of the housing 1, through the gap, it is possible to insert the connection end portion 41 of the connection target 4 into the insertion portion 11 of the housing 1 until the tip end of the connection end portion 41 of the connection target 4 comes into contact with the end portion 14 of the housing 1. At this time, since the actuator 2 is located at the open position and thus the upper part of the insertion portion 11 of the housing 1 is opened, it is possible to easily insert the connection target 4 by inserting the connection target 4 such that both side portions of the connection end portion 41 of the connection target 4 are along the inner surface of the pair of side wall portions 17 of the housing 1, even when the size of the connector is small.

Figure 7:
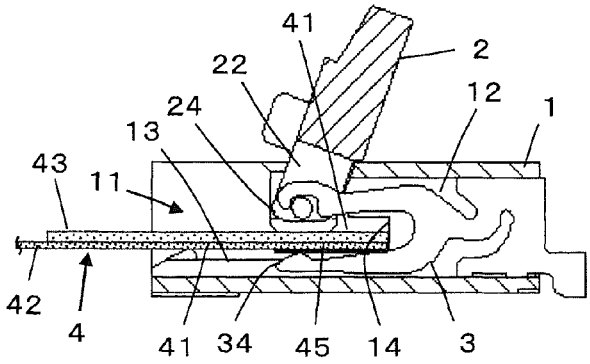
FIG. 7 is a cross-sectional view which is taken along the line C-C in FIG. 6B.

FIG. 7 illustrates a cross section of the connector at the position in which the contact 3 is arranged when the tip end of the connection end portion 41 of the connection target 4 is inserted up to the back portion of the insertion portion 11 of the housing 1. A contact portion 45 is formed on the underside of the connection end portion 41 of the connection target 4, that is, on the underside of the insulated substrate 42, and when the tip end of the connection end portion 41 of the connection target 4 comes into contact with the end portion 14 of the housing 1, the contact portion 45 of the connection target 4 is located right above the contact portion 34 of the corresponding contact 3. However, since a force which causes the contact portion 45 of the connection target 4 and the contact portion 34 of the contact 3 to be pressed with each other does not act, an electrical connection between both is not established yet.

Figure 8:
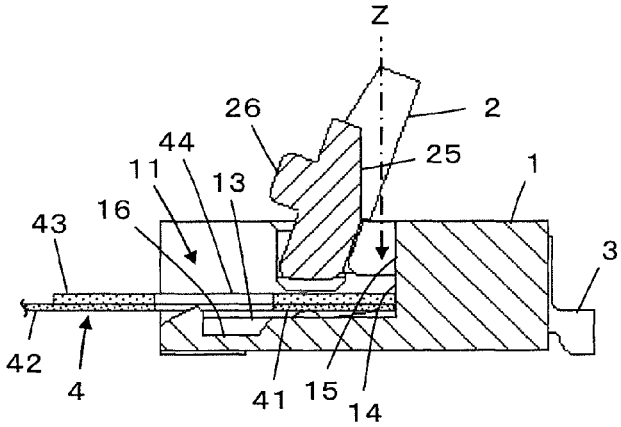
FIG. 8 is a cross-sectional view which is taken along the line D-D in FIG. 6B.
Figure 9:
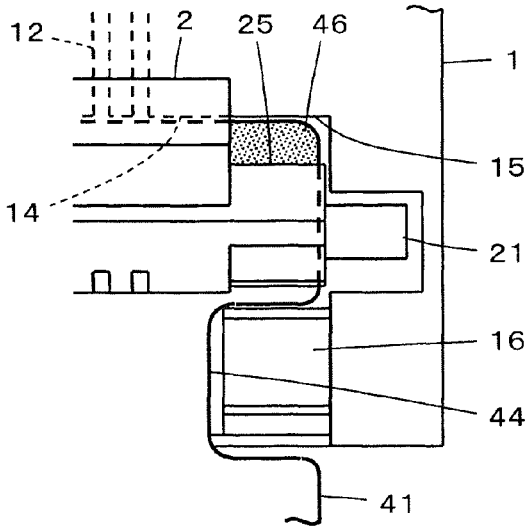
FIG. 9 is a partial plan view illustrating the state of before locking the connector according to the first embodiment into which the connection target is inserted.

At this time, as illustrated in FIG. 8, the tip end of the connection end portion 41 of the connection target 4 also comes into contact with the confirmation groove 15 which is flush with the end portion 14 of the housing 1, and since the portion of the actuator 2 which is located right above the confirmation groove 15 is cut out, there are no members which are present right above the confirmation groove 15. For this reason, when checking the back portion of the insertion portion 11 through the confirmation groove 15 from the position Z which is right above the confirmation groove 15, it is possible to view a tip end position 46 of the connection end portion 41 of the connection target 4 in the confirmation groove 15 as illustrated in FIG. 9.

In this manner, it is possible to confirm the insertion of the connection target 4 by viewing the tip end positions 46 at both ends of the connection end portion 41 of the connection target 4 through the corresponding confirmation grooves 15, respectively.

Figure 10A:
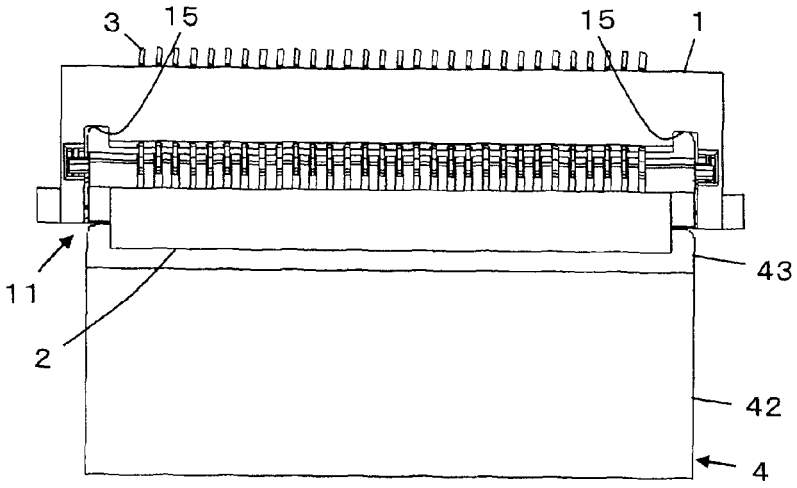
Figure 10B:
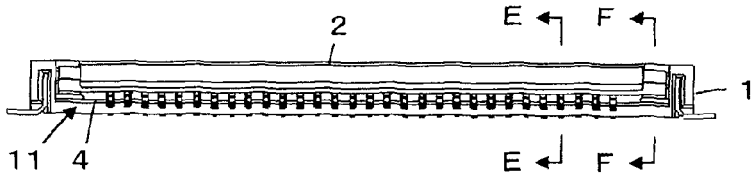
Figure 10C:
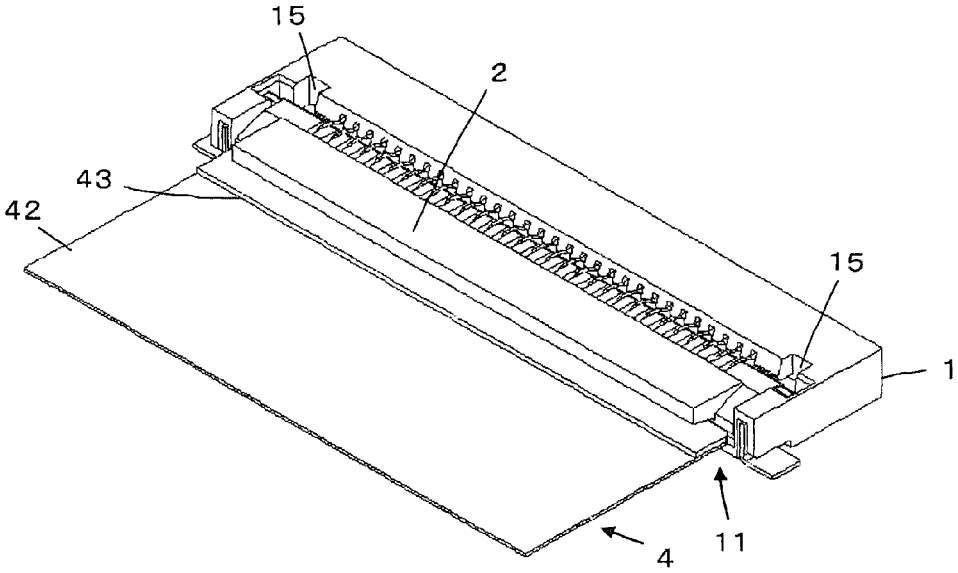

After confirming that the connection target 4 is inserted up to the predetermined position as described above, the actuator 2 is located at the closed position by causing the actuator 2 to rotate around the shaft portion 21 as illustrated in FIGS. 10A to 10C. The actuator 2 covers the upper part of the insertion portion 11 of the housing 1, and the connector has an appearance of approximate rectangular shape having a height of approximately 1 mm to 2 mm. The pair of confirmation grooves 15 which are arranged in the vicinity of both side ends of the housing 1 are in the state of being exposed to the outside.

Figure 11:
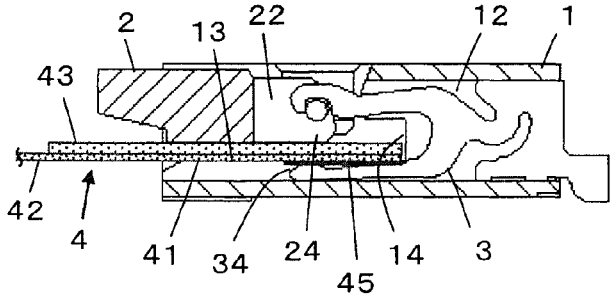
FIG. 11 is a cross-sectional view which is taken along the line E-E in FIG. 10B.

At this time, as illustrated in FIG. 11, the gap between the pressing portion 24 of the cam structure of the actuator 2 and the base 13 of the insertion portion 11 of the housing 1 becomes narrow, the connection end portion 41 of the connection target 4 which is inserted into the insertion portion 11 of the housing 1 is pressed toward the base 13 of the insertion portion 11 by the actuator 2, and whereby the electrical connection is established between the contact portion 45 which is formed on the underside of the connection end portion 41 of the connection target 4 and the contact portion 34 of the contact 3.

At the same time, the connection end portion 41 of the connection target 4 is mechanically held by a predetermined holding force between the actuator 2 and the base 13 of the insertion portion 11 of the housing 1, and the insertion position of the connection target 4 to the insertion portion 11 of the housing 1 is locked.

Figure 12:
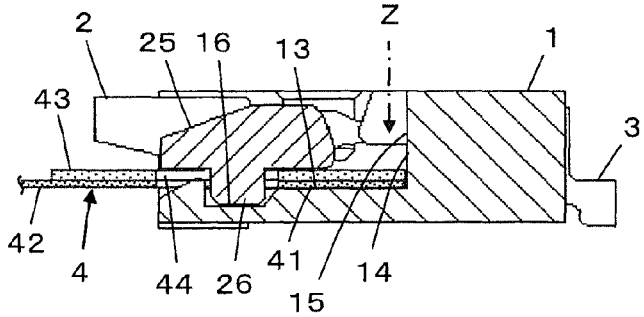
FIG. 12 is a cross-sectional view which is taken along the line F-F in FIG. 10B.

Further, as illustrated in FIG. 12, the convex portions 26 which are formed at both side end portions of the actuator 2 are fitted into the corresponding concave portions 16 of the housing 1 through the cutout portions 44 of the connection target 4, respectively. Therefore, even if an external force of pulling out the connection target 4 from the connector acts on the connection target 4 with a magnitude exceeding the predetermined holding force by the actuator 2, the insertion position of the connection target 4 is maintained, and it is possible to prevent the electrical connection between the contact portion 45 of the connection target 4 and the contact portion 34 of the contact 3 from being interrupted, since peripheral portions of the cutout portions 44 of the connection target 4 are engaged with the convex portions 26 of the actuator 2.

Figure 13:
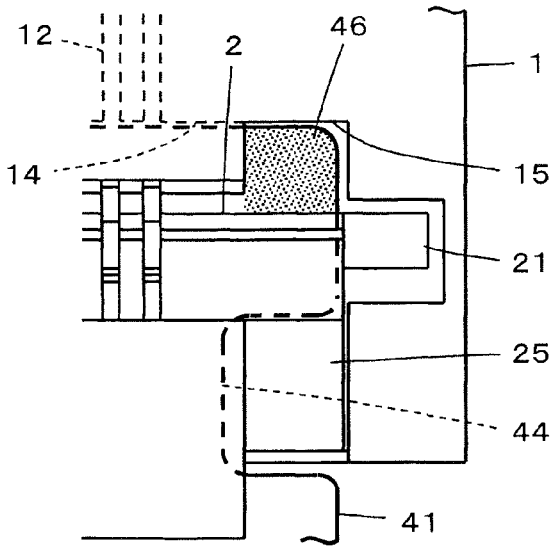
FIG. 13 is a partial plan view illustrating the state of after locking the connector according to the first embodiment into which the connection target is inserted.

In addition, at this time, since the confirmation groove 15 of the housing 1 is exposed to the outside as illustrated in FIG. 12, when checking the back portion of the insertion portion 11 through the confirmation groove 15 from the position Z which is right above the confirmation groove 15, it is possible to view the tip end position 46 of the connection end portion 41 of the connection target 4 in the confirmation groove 15 as illustrated in FIG. 13. By viewing the tip end positions 46 at both ends of the connection end portion 41 of the connection target 4 through the corresponding confirmation grooves 15, respectively, it is possible to confirm the insertion of the connection target 4 even when the position of the connection target 4 is locked.

In the first embodiment, since the confirmation grooves 15 are formed in the housing 1 instead of the inspection hole in the related art, and the surfaces 25 which are inclined at a predetermined angle to the top face 27 of the center portion of the actuator 2 are formed at both side ends of the actuator 2, it is possible to more easily manufacture the housing 1 and the actuator 2 by step processing of a metal mold. In addition, even when the connector is miniaturized, resin for molding easily flows in the metal mold, a warp of molded goods is suppressed, and a decrease in strength of molded goods is prevented.

The connector according to the first embodiment is an extremely small connector, and the height of the housing 1 is approximately 1 mm to 2 mm. Accordingly, the width of the pair of confirmation grooves 15 formed in the housing 1 is also smaller than 1 mm. Therefore, by making the color of the connection end portion 41 of the connection target 4, in particular, the color of the reinforcing plate 43 which forms the top face of the connection end portion 41 and the color of the housing 1 different from each other, it is possible to easily confirm the insertion of the connection target 4 from right above the confirmation groove 15 even when the confirmation groove 15 is small.

Second Embodiment:

As illustrated in FIG. 3, in the first embodiment, the actuator 2 has the surface 25 which is approximately vertical to the base 13 of the insertion portion 11 of the housing 1 when being located at the open position. However, the surface 25 is not limited to this, and it may be in the state in which the base 13 of the back portion of the insertion portion 11 can be viewed through the confirmation groove 15 from right above the confirmation groove 15 by cutting out the portion of the actuator 2 which is located right above the confirmation groove 15 of the housing 1.

Figure 14:
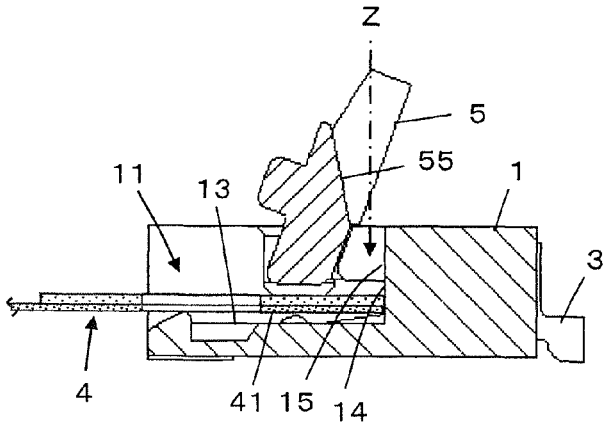
FIG. 14 is a cross-sectional view illustrating the state in which an actuator in a connector according to the second embodiment of the present invention is located at the closed position.
Figure 15:
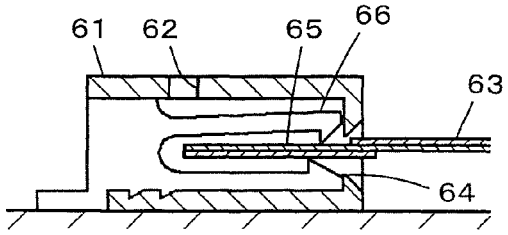
FIG. 15 is a cross-sectional view illustrating a connector in the related art.
Figure 16:
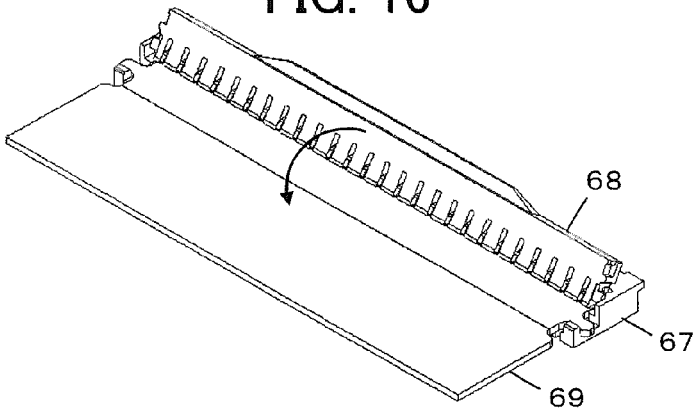
FIG. 16 is a perspective view illustrating another connector in the related art.
Figure 17:
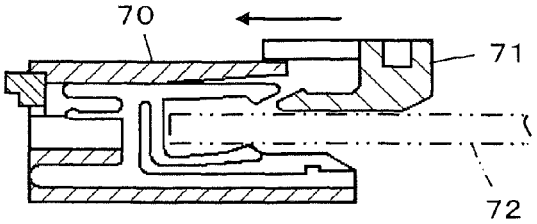
FIG. 17 is a cross-sectional view illustrating yet another connector in the related art.

For example, as in an actuator 5 illustrated in FIG. 14, the actuator 2 may have a surface 55 which is inclined toward the front side of the housing 1, that is, a surface which is inclined such that more a portion in the surface is upper side, more the portion is far from the confirmation groove 15, when the actuator 2 is located at an open position. By using such an actuator 5, it is possible to easily inspection the confirmation groove 15 from above, and it is possible to easily view the tip end position of the connection end portion 41 of the connection target 4 which is inserted up to the back portion of the insertion portion 11, through a confirmation groove 15 from the position Z which is right above the confirmation groove 15.

However, when the surface 55 which is inclined toward the front side of the housing 1 in the open position is formed, the thickness of both side end portions of the actuator 5 become thin to that extent, and there is a concern that the strength of the actuator 5 may be decreased.

In contrast to the above, if it is possible to view the base 13 of the back portion of the insertion portion 11 through the confirmation groove 15 from right above the confirmation groove 15, the actuator 2 may a surface which is inclined toward the back side of the housing 1, that is, a surface which is inclined such that more a portion in the surface is upper side, more the portion is close to the confirmation groove 15, when the actuator 2 is located at an open position.

However, since the confirmation groove 15 becomes small in a small connector, if the actuator has the surface which is inclined toward the back side of the housing 1 in the open position, it becomes difficult to check the confirmation groove 15 from above.

Accordingly, when configuring a small connector, it is preferable that like the actuator 2 according to the first embodiment, the actuator has the surface 25 which is approximately vertical to the base 13 of the insertion portion 11 of the housing 1 when the actuator is located at the open position, in order to secure the strength of the actuator, and to make viewing from the above through the confirmation groove 15 easy.

In the above described first and second embodiments, the housing 1 has the pair of confirmation grooves 15, and tip end positions on both ends of the connection end portion 41 of the connection target 4 are viewed through the pair of confirmation grooves 15. However, in case that the connection target 4 is inserted into the insertion portion 11 of the housing 1 without being largely inclined to the connector, by being guided to the side wall portions 17 of the housing 1, even if only one confirmation groove 15 is formed in the housing 1 and the tip end position of the connection end portion 41 of the connection target 4 is viewed through the one confirmation groove 15, it is possible to confirm the insertion of the connection target 4.

In addition, in the above described first and second embodiments, the FPC is used as the connection target 4. However, it is possible to similarly perform the connection, confirming of insertion, and locking of a sheet shaped or a flat-plate shaped connection target other than FPC, such as the FFC, or the like.

What is claimed is:

1. A connector comprising:

a housing having an insertion portion, an upper part of which is opened so as to permit insertion of a connection end portion of a connection target having a plurality of contact portions and at least one notch, said housing further including at least one confirmation groove for viewing a tip end position of the connection end portion of the connection target inserted into the insertion portion from above, and at least one concave portion formed at the base of the insertion portion;

an actuator rotatably attached to the housing and rotatable between an open position where the upper part of the insertion portion is opened and a closed position where the upper part of the insertion portion is covered, the actuator having at least one cut out portion which is located right above the confirmation groove of the housing when the actuator is located at the open position, and at least one convex portion formed on a surface of the actuator which is on an opposite side face relative to the at least one cut out portion and corresponds to the at least one concave portion of the housing; and a plurality of contacts fixed to the housing, wherein the connection target is mechanically held in the housing with the plurality of contact portions of the connection target being electrically connected to the plurality of contacts, and the at least one convex portion of the actuator is fitted into the corresponding at least one concave portion of the housing through said at least one connection target notch, by rotating operation of the actuator in relation to the housing.

2. The connector according to claim 1, wherein the housing has a pair of the confirmation grooves for viewing the tip end positions on both ends of the connection end portion of the connection target.

3. The connector according to claim 2, wherein the cutout portion of the actuator has a surface which is approximately vertical relative to the base of the insertion portion when the actuator is located at the open position.

4. The connector according to claim 1, wherein the cutout portion of the actuator has a surface which is approximately vertical relative to the base of the insertion portion when the actuator is located at the open position.

* * * * *